United States Patent [19]

Furuya

[11] 4,263,770

[45] Apr. 28, 1981

[54] VIBRATION INTERRUPTING DEVICE FOR COIN WRAPPING MACHINE

[75] Inventor: Katusuke Furuya, Tokyo, Japan

[73] Assignee: Laurel Bank Machine Co., Ltd., Tokyo, Japan

[21] Appl. No.: 62,796

[22] Filed: Aug. 1, 1979

[30] Foreign Application Priority Data

Aug. 3, 1978 [JP] Japan ..... 53-106759[U]

[51] Int. Cl.[3] ..... B65B 57/14; B65B 11/04; B65B 1/22

[52] U.S. Cl. ..... 53/501; 53/525; 53/212; 318/762

[58] Field of Search ..... 53/501, 525, 437, 212; 318/762

[56] References Cited

U.S. PATENT DOCUMENTS 3,798,523 3/1974 Gross ..... 318/762

*Primary Examiner*—Horace M. Culver

*Attorney, Agent, or Firm*—Fleit & Jacobson

[57] ABSTRACT

Herein disclosed is a vibration interrupting device for use with a coin wrapping machine, in which coins are conveyed, while being counted, to a piling cylinder, in which this cylinder is vibrated by a vibrator so that the coins may be regularly piled in the cylinder, and in which a preset number of coins piled are carried to wrapping rollers by a coin receiving arm so that they may be wrapped. The vibration interrupting device includes a brake circuit which is operative to control the vibrator such that the vibrations to be applied to the piling cylinder are promptly interrupted by the time when the coin receiving arm is brought to receive the preset number of the coins piled in the cylinder. Thus, the coins piled can be prevented from being destroyed to pieces or getting scattered or lost when they are to be carried by the coin receiving arm.

2 Claims, 4 Drawing Figures

VIBRATION INTERRUPTING DEVICE FOR COIN WRAPPING MACHINE

BACKGROUND OF THE INVENTION

1. Field of the Invention

The present invention relates to a coin wrapping machine, and more particularly to a vibration interrupting device for use with the coin wrapping machine.

2. Description of the Prior Art

A variety of coin packing machines have been proposed and developed but they cannot be free from intrinsic drawbacks, as will be discussed later with reference to the accompanying drawings.

SUMMARY OF THE INVENTION

It is an object of the present invention to provide a vibration interrupting device for use with a coin wrapping machine, in which the rotations of an electric motor due to its inertia are promptly stopped to interrupt the vibrations to be applied to a coin piling cylinder by the motor by the time when a coin receiving arm is brought to receive a preset number of coins piled in the piling cylinder.

According to a major feature of the present invention, there is provided a vibration interrupting device in a coin wrapping machine including a piling cylinder for piling therein coins being conveyed thereto, conveyor means for conveying the coins to said piling cylinder, counting means for counting the coins being conveyed to said piling cylinder by said conveyor means, vibrator means for vibrating said piling cylinder so that the coins may be regularly piled therein, a plurality of wrapping rollers for wrapping the coins carried into the space defined thereby, and a coin receiving arm made movable for receiving a preset number of coins piled in said piling cylinder and for carrying them into the space of said wrapping rollers, said vibration interrupting device comprising a brake circuit for controlling said vibrator means such that the vibrations to be applied to said piling cylinder are promptly interrupted by the time when said coin receiving arm is brought to receive the preset number of the coins piled in said piling cylinder.

BRIEF DESCRIPTION OF THE DRAWINGS

Other objects and advantages of the present invention will become apparent from the following description taken in conjunction with the accompanying drawings, in which.

DESCRIPTION OF THE PREFFERED EMBODIMENT

Figure 1:
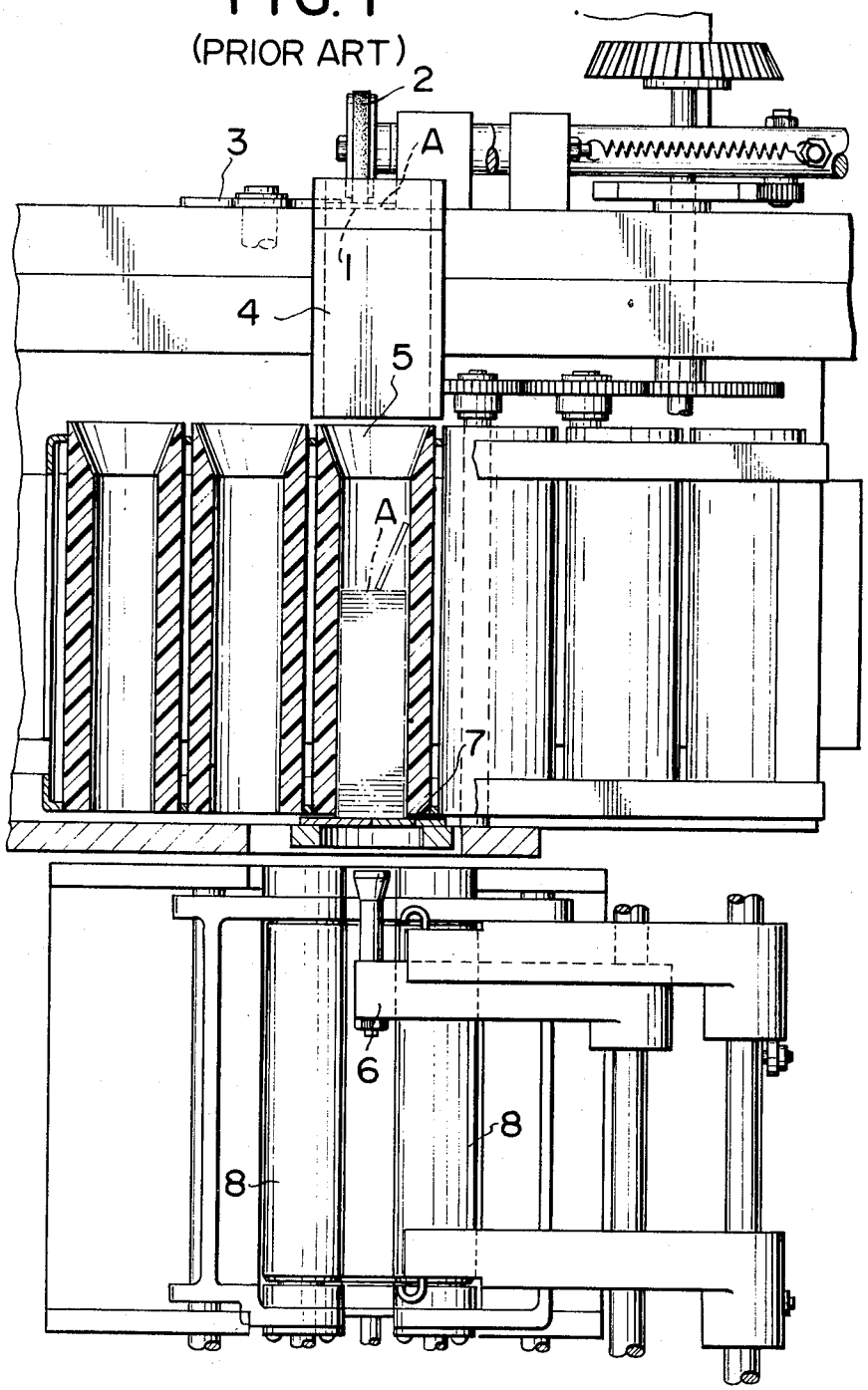
FIG. 1 (PRIOR ART)
FIG. 1 is a partially sectional front elevation showing an essential portion of a coin wrapping machine according to the prior art.
Figure 2:
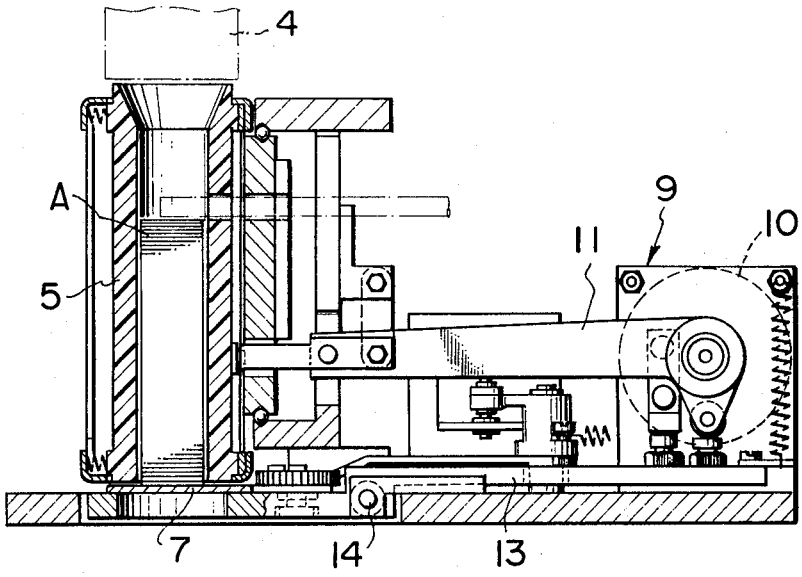
FIG. 2 (PRIOR ART)
FIG. 2 is a partially sectional side elevation showing a portion of the coin wrapping machine of FIG. 1.

Before entering into the detailed description of the present invention, one of the prototype coin wrapping machines according to the prior art will be described so that the construction and operation of the vibration interrupting device to be used with the coin packing machine may be better understood. Referring first to FIGS. 1 and 2, a preset kind of selected coins A are forcibly conveyed on a coin passage 1 by means of a conveyor belt 2 and are piled one on another in a piling cylinder 5 by way of a chute 4 after they are counted by means of a counting wheel 3. When a preset number of the coins A are piled in the cylinder 5, a coin receiving arm 6 is lifted toward a coin table 7, which is then removed so that the piled coins A are received on the coin receiving arm 6. After that, the coins A thus received are carried into the space among the wrapping rollers 8, which are arranged below, so that they are wound with wrapping paper thereby to produce a coin package.

On the other hand, the piling cylinder 5 of the coin packing machine thus constructed is connected to a vibrator 9, which is operative to apply vibrations to the fed coins A so that they may be regularly arranged and piled in the piling cylinder 5. More specifically, the vibrator 9 applies both the horizontal vibrations to the piling cylinder 5 by means of a vibrating arm 11, which has its one end connected eccentrically to the output shaft of an electric motor 10 and its leading other end connected to the side wall of the piling cylnder 5, and the vertical vibrations to the cylinder 5 by means of a rocking lever 13 which is rockedabout a pivot pin 14 by the vibrating arm 11.

In order to increase the wrapping speed of the coin wrapping machine, it is necessary to pile a preset number of the coins stably in the piling cylinder 5 as soon as possible and to transfer them onto the coin receiving arm 6. In this respect, however, the motor 10 of the vibrator 9 is adapted to be deenergized, at the instant when a preset number of coins are piled, but it will fail to be instantly stopped due to its considerable inertia. As a result, even when the coins A piled in the cylinder 5 are to be placed on and carried down by the coin receiving arm 6, the piling cylinder 5 is being still vibrated by the inertia of the motor 10. Thus, it may invite a drawback that the pile of the coins A will be destroyed to pieces by the vibrations transmitted. If, on the other hand, the motor 10 is stopped in advance while considering the inertia of the motor 10, the last coin A to be piled in the cylinder 5 may stand in such a position as shown in single-dotted lines in FIG. 1. If the coins A having the last one in that standing position are taken out of the cylinder 5, then the standing coin A may drop from the remaining piled coins A, and in the worst case it gets so scattered and lost so as to invite another drawback that the desired stable coin wrapping operations cannot be expected.

Figure 3:
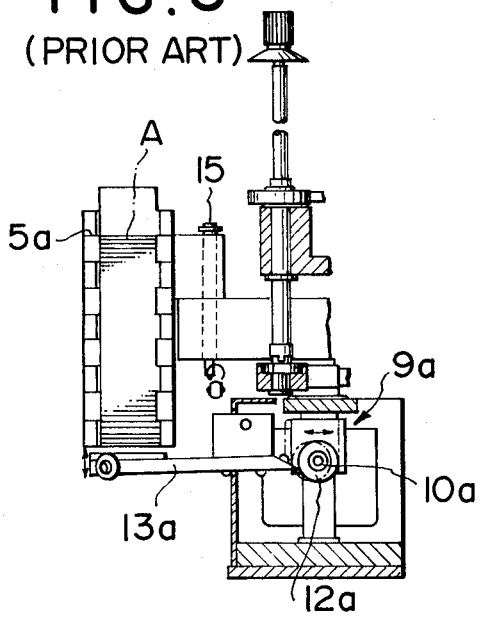
FIG. 3 (PRIOR ART)
FIG. 3 is also a partially sectional side elevation showing an essential portion of another coin wrapping machine according to the prior art.

Another coin packing machine, as shown in FIG. 3, is also developed according to the prior art. In this second conventional coin wrapping machine, one of the piling cylinder halves 5*a*, which can be vertically separated from each other, is turned about a pivot pin 15 so that the piling cylinder can be opened. Then, the coins A piled in the cylinder are held at their top and bottom between a coin receiving arm, not shown, and are carried by the same into the space among wrapping rollers, not shown, so that they may be wrapped thereby. A vibrator 9*a* is also provided for applying vibrations to the cylinder halves 5*a*. The vibrator 9*a* is equipped with an eccentric cam 12*a*, which is connected to the output shaft of an electric motor 10 so that a rocking lever 13*a* is rocked by the eccentric cam 12*a* thereby to vertically vibrate the piling cylinder as a whole.

However, the coin wrapping machine of this second type cannot be free from the similar drawbacks to those of the first type machine.

Figure 4:
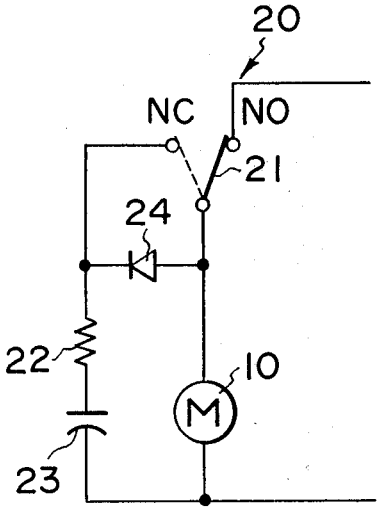
FIG. 4 is a diagram showing a brake circuit constituting a portion of a vibration interrupting device according to the present invention.

Turning now to FIG. 4, the present invention will be described in connection with the embodiment thereof. Incidentally, the mechanical components or parts of the coin wrapping machine having a vibration interrupting device according to the present invention may be common with or similar to those in the conventional machines of FIGS. 1 and 2, and as such their repeated explanations are omitted here.

In FIG. 4 showing a brake circuit 20, the electric motor (A.C. motor) 10 of the vibrator 9 is made to have its one terminal connected with one terminal of a power source The other terminal of the motor 10 is connected with a microswitch 21 which is made operative when the coin receiving arm 6 is lifted to receive the coins A piled in the cylinder 5. The microswitch 21 has its NO (normally open) terminal connected with the other terminal of the power source and its NC (normally closed) terminal connected through a resistor 22 with one terminal of a capacitor 23. The other terminal of this capacitor 23 is connected with the aforementioned one terminal of the motor 10. Moreover, there is connected between the NC terminal of the microswitch 21 and the aforementioned other terminal of the motor 10 a rectifier 24 which is made operative to allow an electric current to flow only in the direction from the motor 10 to the resistor 22.

The operations of the coin wrapping machine thus constructed will be described in the following. First of all, when the operating button of the coin wrapping machine is depressed after the main switch has been depressed, preset kinds of selected coins A are forcibly conveyed on the coin passage 1 by means of the conveyor belt 2, while being counted by the counting wheel 3, so that they are piled through the chute 4 in the piling cylinder 5. In this meanwhile, the microswitch 21 of the brake circuit 20 is turned on through its NO terminal so that the motor 10 of the vibrator 9 is turned to vibrate the piling cylinder 5. When a circuit is made through the NO terminal of the microswitch 21 in that way, the capacitor 23 is charged through the rectifier 24 and the resistor 22. On the other hand, when the preset number of coins A are piled in the cylinder 5, as has been described before, the conveyor belt 2 is stopped, and the coin receiving arm 6 is lifted. When this lift takes place, the microswitch 21 has its connection switched to the NC terminal. At this instant, a braking force is applied to the motor 10 by the discharge of the capacitor 23 so that the motor 10 is instantly stopped. As a result, the vibrations of the piling cylinder, which might otherwise be caused by the inertia, can be prevented. Thus, the pile of the coins A is placed on and carried by the lower wrapping rollers 8 so that it is wrapped in a conventional manner.

As has been described in detail hereinbefore, according to the present invention, the coin receiving arm is made movable to receive the piled coins, and at the same time there is provided the brake circuit which can instantly stop the vibrations being applied to the piling cylinder. Thus, the piled coins can be prevented from being destroyed to pieces, while they are being carried to the wrapping rollers by the coin receiving arm, as a result that the piling cylinder is vibrated by the inertia of the motor of the vibrator. Since, moreover, it is unnecessary to interrupt in advance the vibrations of the piling cylinder while taking the inertia of the motor into consideration, as is quite different from the conventional coin wrapping machine, there can be precluded the disadvantages that the coin counted last is left in its standing position. Since, still moreover, the transfer of the coins to their receiving arm can be accomplished stably within a short time period, the present invention can also have an excellent effect in improving the efficiency of the coin wrapping machine.

What is claimed is:

1. A coin wrapping machine including a piling cylinder for piling therein coins being conveyed thereto, conveyor means for conveying the coins to said piling cylinder, counting means for counting the coins being conveyed to said piling cylinder by said conveyor means, vibrator means including an AC motor connectable to and AC power source for vibrating said piling cylinder so that the coins may be regularly piled therein, a plurality of wrapping rollers for wrapping the coins carried into the space defined thereby, a coin receiving arm made movable for receiving a preset number of coins piled in said piling cylinder and for carrying them into the space of said wrapping rollers, and a vibration interrupting device comprising a brake circuit for controlling said vibrator means such that the vibrations to be applied to said piling cylinder are promptly interrupted by the time when said coin receiving arm is brought to receive the preset number of the coins piled in said piling cylinder, said brake circuit comprising means operative during running of said AC motor for rectifying AC current to produce a rectified current, means responsive to the rectified current for storing an electric charge, and means for applying the stored electric charge as DC current to said AC motor so as to brake the same.

2. A coin wrapping machine according to claim 1, further comprising switch means for controlling said motor movable between a first position in which said AC motor is connected to the AC power source and a second position in which said AC motor is disconnected from the AC power source and connected to said brake circuit.

* * * * *